US011744294B2

(12) United States Patent
Kwon et al.

(10) Patent No.: US 11,744,294 B2
(45) Date of Patent: Sep. 5, 2023

(54) CARTRIDGE PACKAGING SYSTEMS AND METHODS

(71) Applicant: Next Level Ventures LLC, Seattle, WA (US)

(72) Inventors: Alex Kwon, Irvine, CA (US); Steven Hwang, San Rafael, CA (US); Alex Gordon, Irvine, CA (US); Audra Horridge, Portland, OR (US)

(73) Assignee: NEXT LEVEL VENTURES LLC, Seattle, WA (US)

( * ) Notice: Subject to any disclaimer, the term of this patent is extended or adjusted under 35 U.S.C. 154(b) by 0 days.

(21) Appl. No.: 18/074,422

(22) Filed: Dec. 2, 2022

(65) Prior Publication Data

US 2023/0172283 A1 Jun. 8, 2023

Related U.S. Application Data

(60) Provisional application No. 63/285,323, filed on Dec. 2, 2021.

(51) Int. Cl.
*A24F 40/70* (2020.01)
*B65B 11/52* (2006.01)
(Continued)

(52) U.S. Cl.
CPC ..... *A24F 40/70* (2020.01); *A24F 7/00* (2013.01); *A24F 40/42* (2020.01); *B65B 7/2842* (2013.01); *B65B 11/52* (2013.01); *B67C 3/02* (2013.01)

(58) Field of Classification Search
None
See application file for complete search history.

(56) References Cited

U.S. PATENT DOCUMENTS

2018/0126066 A1 5/2018 Narvekar et al.
2018/0354769 A1* 12/2018 Cacciatore ..... B67C 3/02
(Continued)

FOREIGN PATENT DOCUMENTS

EP 3822178 A1 5/2021

OTHER PUBLICATIONS

USPTO acting as International Searching Authority, "International Search Report and Written Opinion," for International Application No. PCT/US2022/051704, dated Mar. 1, 2023.
(Continued)

*Primary Examiner* — James Harvey
(74) *Attorney, Agent, or Firm* — Dentons Durham Jones Pinegar; Sarah W. Matthews

(57) ABSTRACT

A vaping device packaging system includes a first tray for holding vaping device bodies, the first tray having a plurality of voids, the voids holding a portion of a vaping device body to be filled with a substance. The first tray and the vaping device bodies are covered by a first cover. A second tray for holding vaping device mouthpieces has a plurality of voids allowing the vaping device mouthpieces to be vertically aligned with the corresponding vaping device bodies of the first tray, each of the voids holding a portion of a vaping device mouthpiece to cap a corresponding vaping device body. The first tray is capable of being placed over a jig having a plurality of jig voids corresponding to the voids for holding the vaping device bodies.

20 Claims, 7 Drawing Sheets

(51) Int. Cl.

| | |
|---|---|
| ***A24F 7/00*** | (2006.01) |
| ***A24F 40/42*** | (2020.01) |
| ***B65B 7/28*** | (2006.01) |
| *B67C 3/02* | (2006.01) |

(56) References Cited

U.S. PATENT DOCUMENTS

| | | | | |
|---|---|---|---|---|
| 2020/0015516 | A1 | 1/2020 | Simpson et al. | |
| 2020/0146336 | A1 | 5/2020 | Lockwood | |
| 2021/0147104 | A1 | 5/2021 | Dodson et al. | |
| 2023/0100889 | A1* | 3/2023 | Sain-Thomason | B09B 3/00 53/440 |
| 2023/0119264 | A1* | 4/2023 | Hwang | A24F 40/10 131/329 |

OTHER PUBLICATIONS

Full Cartridge Filling Automation—New ATG Pharma, Jupiter, and Convectium Collaboration, available at https://www.youtube.com/watch?app=desktop&v=SxQHCidmj9c, at least as early as May 27, 2020.

* cited by examiner

CARTRIDGE PACKAGING SYSTEMS AND METHODS

CROSS REFERENCE TO RELATED APPLICATIONS

This application claims priority to U.S. Provisional Patent Application No. 63/285,323 entitled "CARTRIDGE PACKAGING SYSTEMS AND METHODS," filed Dec. 2, 2021 (the '323 Provisional Application). The entire disclosure of the '323 Provisional Application is hereby incorporated herein.

TECHNICAL FIELD

Electronic smoking consumption, or "vaping," is an activity that has seen a recent increase in popularity. There are currently a large variety of vaping devices and liquids available on the market. One way in which vaping liquids are consumed is by a user inhaling a vaporized aerosol from a cartridge. This vaporized aerosol may be generated by heating a liquid solution stored in the cartridge. Aspects of the invention include an apparatus and method that increases the efficiency of packaging multiple vaping cartridges at one time.

BRIEF SUMMARY OF THE INVENTION

In one aspect, a vaping liquid packaging system is comprised of: a first tray formed of deformable material for holding vaping device bodies, the first tray having a plurality of voids, where each of the voids hold a portion of a vaping device body to be filled with a substance. The first tray and the vaping device bodies are covered by a first cover. The system may also include a second tray formed of deformable material for holding vaping device mouthpieces, the second tray having a plurality of voids allowing the vaping device mouthpieces to be vertically aligned with the vaping device bodies of the first tray, with each of the voids holding a portion of a vaping device mouthpiece to cap a corresponding vaping device body. The first tray is capable of being placed over a jig having a plurality of jig voids corresponding to the voids for holding the vaping device bodies. The jig voids comprise a stepped portion within the jig voids, with the stepped portion forming a concentric circle with the jig voids. The second tray is capable of being placed over the first tray to allow a press to exert even pressure on the vaping device mouthpieces of the second tray to press-fit the vaping device mouthpieces onto the corresponding vaping device bodies, where the stepped portion of the jig void is for transferring pressure from the vaping device mouthpieces to a corresponding bottom side of a tank portion of the vaping device bodies when the press exerts even pressure on the vaping device mouthpieces.

According to another aspect, a vaping device packaging system comprises: a first tray for holding vaping device bodies, with the first tray having a plurality of voids for holding a portion of a vaping device body to be filled with a substance. The first tray and the vaping device bodies are covered by a first cover. The system also includes a second tray for holding vaping device mouthpieces, the second tray having a plurality of voids allowing the vaping device mouthpieces to be vertically aligned with the vaping device bodies of the first tray. Each of the voids hold a portion of a vaping device mouthpiece to cap a corresponding vaping device body. The first tray is capable of being placed over a jig having a plurality of jig voids corresponding to the voids for holding the vaping device bodies.

According to another aspect, a method is provided for packing vaping devices. A method of packaging vaping devices can comprise selecting a first tray for holding vaping device bodies, the first tray having a plurality of voids, and inserting a portion of a vaping device body into each of the plurality of voids of the first tray. The method may also include covering the first tray and the vaping device bodies with a first cover and selecting a second tray for holding vaping device mouthpieces, the second tray having a plurality of voids. The method may further include inserting a portion of a vaping device mouthpiece into each of the plurality of voids in the second tray.

DETAILED DESCRIPTION

With reference to FIGS. 1-4, a receiver tray or jig 10 may be designed as a rectangular (cubic) structure with orifices, openings, voids, or holes 15. In some embodiments, each hole or jig void 15 may be a cylindrical cavity with an axis that is substantially perpendicular to a horizontal ground plane when the receiver tray is placed flat on a plane parallel to the horizontal ground plane. Each hole 15 may be internally contoured for convenient insertion and removal of a vaping cartridge or a vaping device body as discussed in more detail below. In other embodiments, the holes 15 have different shapes and sizes to accommodate vaping device bodies of different shapes and sizes.

Figure 1:
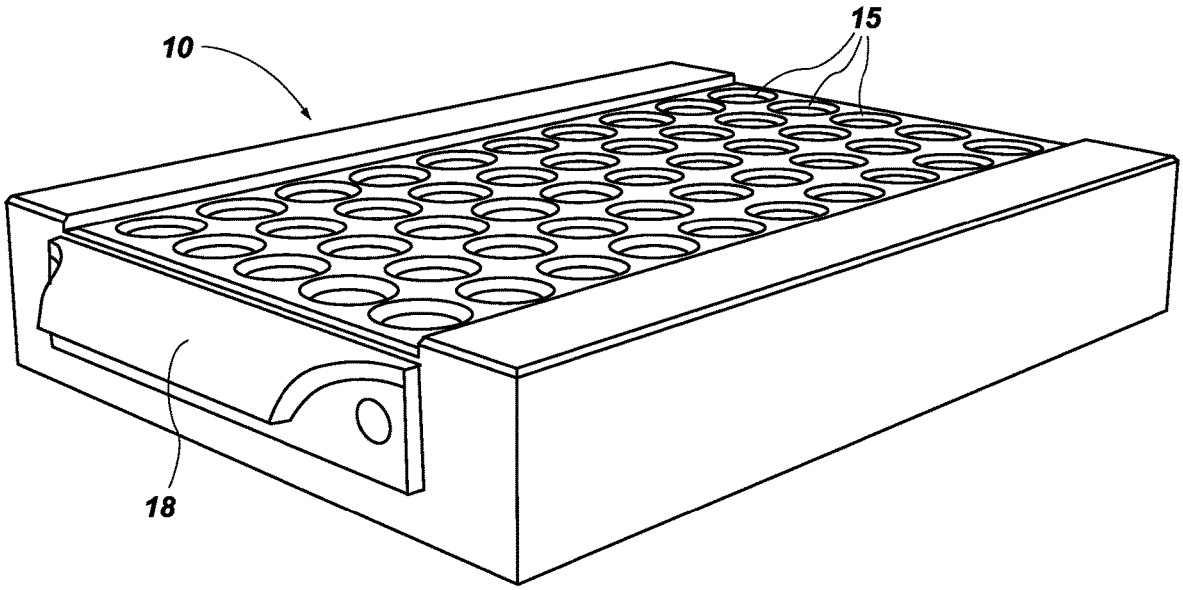
FIG. 1 provides a pictorial representation of a jig or receiver tray according to one embodiment.
Figure 2:
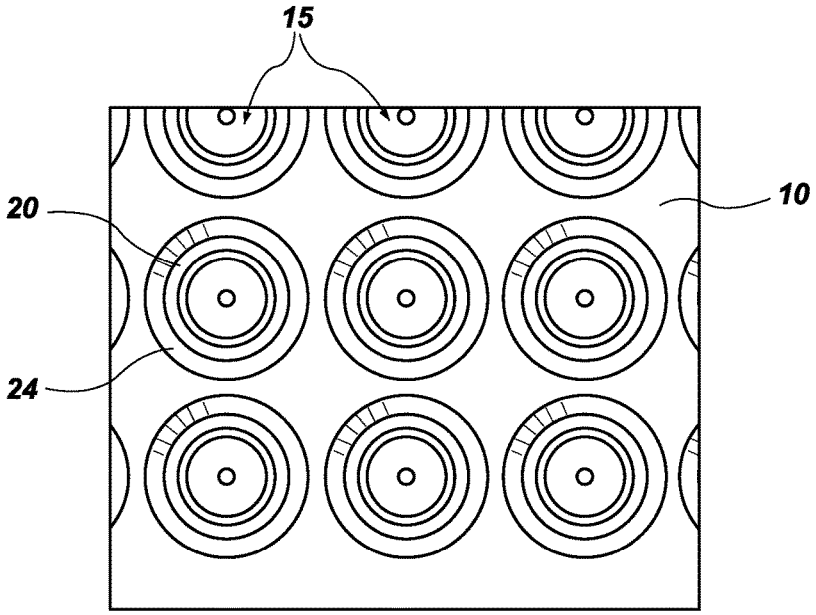
FIG. 2 provides an up-close view of jig voids in a jig.

A receiver tray or jig 10 may have several holes, or a plurality of jig voids 15, with each hole 15 being configured to hold a single cartridge. A jig or receiver tray 10 can be any shape or size and includes rectangular trays, square trays, or any other structure to hold one or more vaping device bodies and guide the vaping device bodies as they are filled and capped. The jig voids 15 in a receiver tray or jig 10 may be spaced at substantially regular intervals in some embodiments. For example, FIG. 1 depicts an embodiment of a jig 10 with a plurality of jig voids 15, formed as a 10×5 matrix (array) of jig voids 15. The receiver tray or jig 10 in FIG. 1 is configured to hold a total of 50 cartridges or vaping device bodies. Other numbers of cartridges and/or configurations for jig voids 15 are possible. The receiver tray or jig 10 may have handles 18 at two of its opposite edges to facilitate holding and transportation of the jig 10. In other embodiments, handles 18 are not provided. FIG. 2 depicts a close-up of the receiver tray or jig 10 and the structure of the holes 15.

In one aspect, each hole or jig void 15 is designed to have a circular cross-sectional profile with varying diameters. In other embodiments, the jig voids 15 have other cross-sectional shapes to hold or partially hold vaping cartridges or all-in-one vaping systems that have varying shapes and sizes. Referring to FIG. 2, the top of a hole or jig void 15 may have a shape of a frustum of a cone, tapering in a downward direction. In other words, the top of the jig void 15 maybe chamfered or have a chamfered edge forming a frustrum section 24. This physical profile serves to appropriately guide and align a cartridge or vaping device body being placed into the hole 15. The frustum section 24 narrows in a downward direction, converging to a first cylindrical section 28 with a first diameter, and then to a second cylindrical section 32 with a second diameter (best seen in FIG. 5). In one aspect, the frustum 24, the first cylindrical section 28, and the second cylindrical section 32 may all be substantially coaxial or concentric. Between the first section 28 and the second section 32 is a stepped portion 20.

Figure 5:
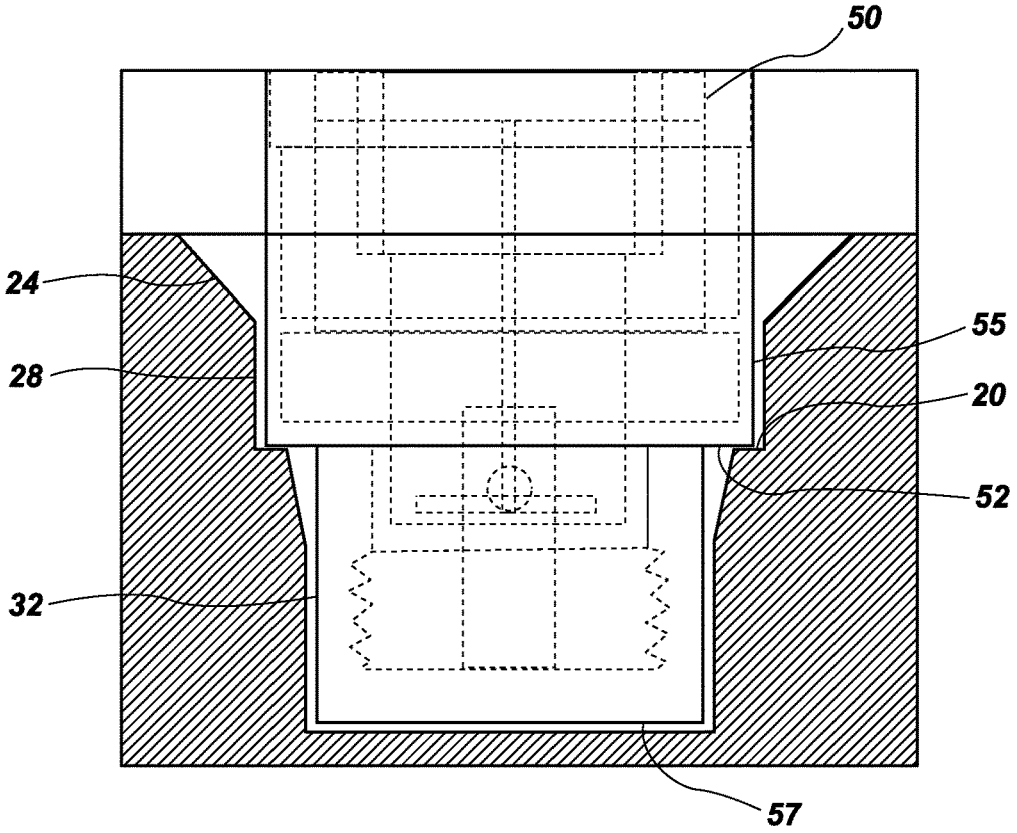
FIG. 5 is a partial cross-sectional view of an embodiment of a jig having a jig void with a vaping device body of a first tray located or seated within the jig void.

Referring to FIG. 5, the first diameter of the first section 28 may be substantially equal to a diameter of the narrow end of the frustum 24. The second diameter of the second section 32 may be smaller than the first diameter. The portion of the hole 15 where the first diameter transitions to the second diameter may be designed to be a flat, circular edge/surface or a stepped portion 20 of the jig void 15. This contoured cross-sectional profile of each hole 15 enables a cartridge to be guided into the hole 15 (by the frustum section 24) and then securely held (by a combination of the first section 28 and second section 32), thereby minimizing any chances of misalignment due to user error and other errors. This contoured profile also minimizes any chances of damaging a cartridge during insertion, filling, and/or capping.

The stepped portion 20 of the hole 15 may have a diameter that is from about 0.5 mm to about 1 mm, or from about 0.6 mm to about 0.9 mm, or from about 0.7 mm to about 0.8 mm. We have learned that during the capping process, the bottom side 57 of a vaping device body may be damaged if the capping pressure from the press is transferred to the bottom side 57 of the vaping device body 50. If a stepped portion 20 is provided within the jig void 15, within a special range, the stepped portion 20 can transfer the capping pressure from the press to the bottom side 52 of the vaping device body tank portion 55, rather than the bottom side 57 of the vaping device body 50. This can reduce damage to the bottom side 57 of the vaping device body 50 during capping. As best seen in FIG. 5, downward pressure on the vaping device body 50 is transferred from the bottom side 52 of the tank portion 55 to the stepped portion 20 of the jig voids 15.

The receiver tray or jig 10 may be configured to hold multiple cartridges or vaping device bodies 50 so the vaping device bodies 50 may be filled with vaping solution (also referred to as "vape juice" or "oil(s)") or other substance. The vaping device bodies 50 may be filled manually, or automatically via a robotic machine.

In one aspect, the vaping device bodies 50 may be loaded into the receiver tray or jig 10 individually. In another aspect, the vaping device bodies 50 may be preloaded into a first tray 40 (a vaping device body tray) and then placed in the jig 10 or receiver tray 10. The first tray 40 is for holding vaping device bodies 50, or at least a portion of a vaping device body. The first tray 40 may define holes or a plurality of voids 44 that physically and spatially match the hole arrangement on the jig 10 or receiver tray. That is, each of the vaping device bodies 50 in the first tray 40 may correspond to a jig void 15.

Figure 3:
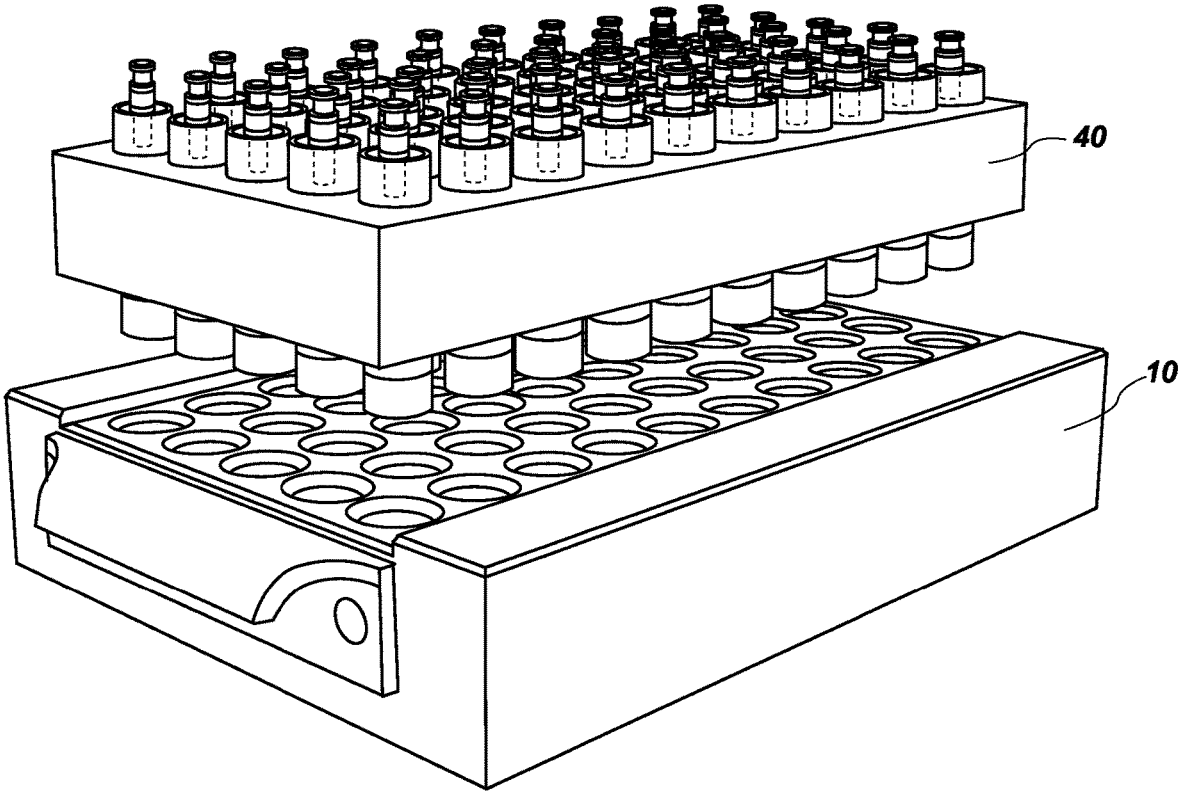
FIG. 3 shows a first tray loaded with vaping device bodies for placement over a jig.
Figure 4:
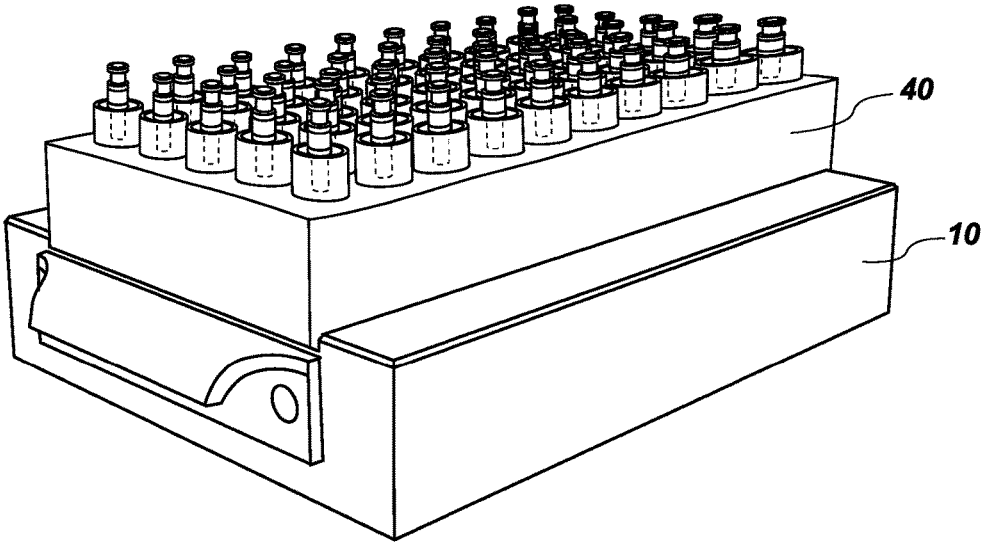
FIG. 4. shows the first tray and jig of FIG. 3 with the vaping device bodies of the first tray loaded into the jig voids of the jig.

The first tray may 40 be formed of any suitable material and in some configurations the material is a deformable material, such as a foam, etc., to provide cushioning for the vaping device bodies 50 during transportation, filling, and capping. The plurality of voids 44 in the first tray 40 may be sized and shaped receive a portion of a vaping device body 50, or a portion of a cartridge body. A pictorial representation of a complete set of vaping device bodies 50 being loaded or placed over a jig 10 using a first tray 40 is shown in FIG. 3. FIG. 4 depicts the full set of vaping device bodies 50 as fully loaded into the jig 10 using the first tray 40 for holding vaping device bodies 50.

The first tray 40 may be loaded or filled with vaping device bodies 50 such that the bottom portion 57 of the vaping device body 50 (for being placed into the jig voids 15 of the jig 10) extend below the first tray 40, and the top portion of the vaping device body 50 (for having mouthpieces capped over) extend above the first tray 40.

The first tray 40, along with the vaping device bodies 50 loaded into the first tray 40, can be provided with a first cover (not illustrated). In some embodiments, the first cover may be a sealed cover to protect the vaping device bodies from any dust, etc., during transport. For example, a sealed plastic cover may surround the first tray 40 and the vaping device bodies 50 loaded into the first tray 40. This may also simplify packaging to facilitate the filling and capping process.

Figure 6:
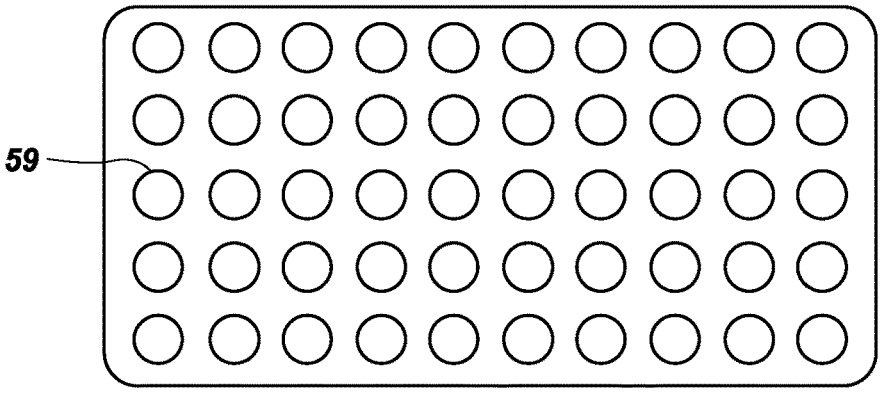
FIG. 6 is a perspective view of an embodiment of an alignment plate.
Figure 7:
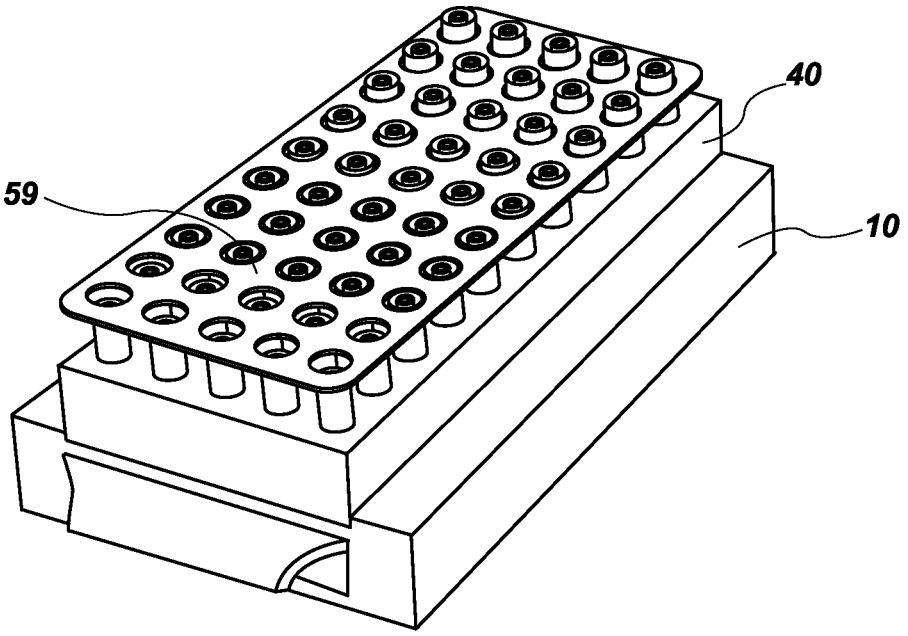
FIG. 7 is a perspective view of an alignment plate being placed over vaping device bodies of a first tray.
Figure 8:
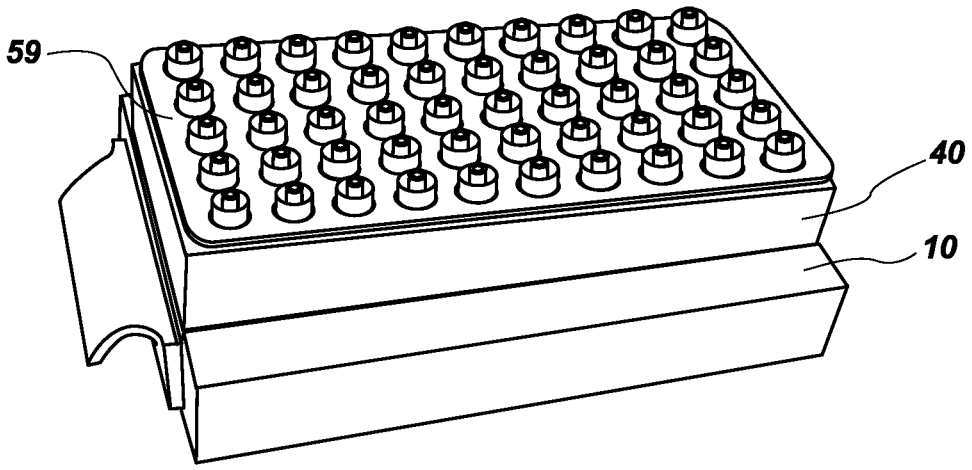
FIG. 8 is a perspective view of the alignment plate of FIG. 7 in place over vaping device bodies of a first tray.

Once the jig 10 has been fully loaded with the vaping device bodies of the first tray 40, an optional step is to place an alignment plate or stabilizer plate 59 on top of the vaping device bodies 50. In one aspect, the stabilizer or alignment plate 59 is a rigid plate (e.g., a plastic or metal plate) that may be configured with holes that physically and spatially match the hole arrangement on the receiver tray 10. Each hole on the stabilizer tray 59 may be diametrically matched with the diameter of a cartridge. Each hole on the stabilizer plate 59 may also physically grasp (i.e., fasten on to) an area towards the top end of each cartridge and hold the cartridge in place. The stabilizer plate 59 ensures that each cartridge is substantially immobile with respect to each other cartridge and the receiver tray 10. In combination, the stabilizer plate 59 and the receiver tray 10 provide a rigid support for an array of cartridges to be processed (i.e., filled and capped). FIG. 6 shows a picture of an embodiment of a stabilizer plate or alignment plate 59. FIG. 7 shows stabilizer/alignment plate 59 being placed over a first tray 40 filled with vaping device bodies 50. FIG. 8 depicts the stabilizer/alignment plate 59 installed in place over a first tray 40.

Figure 9:
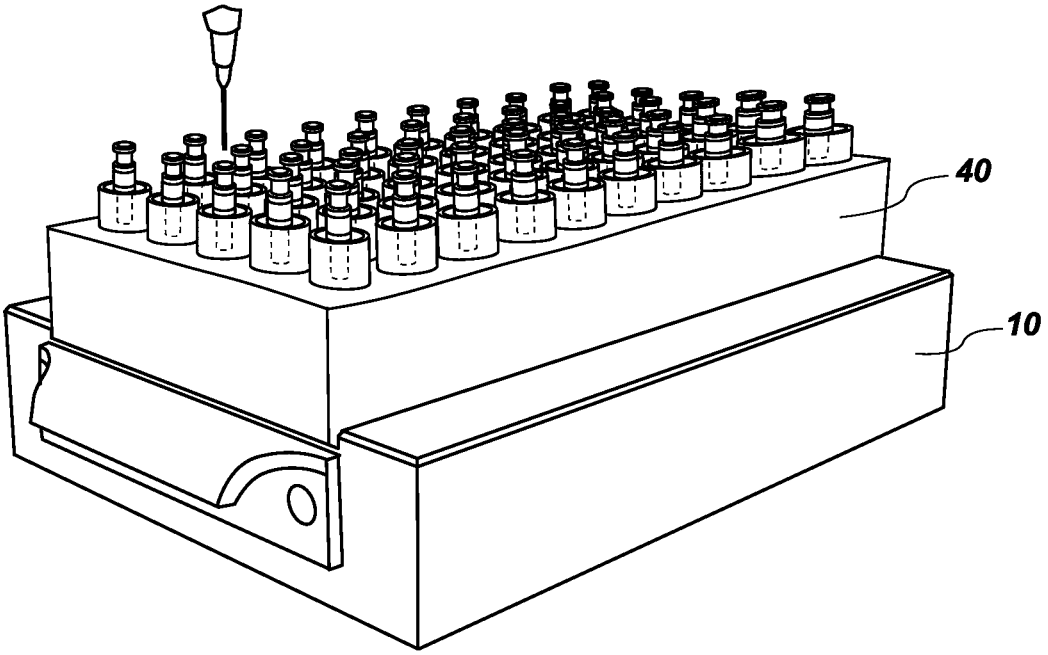
FIG. 9 is a perspective view of vaping device bodies being filled by a robotized filling machine.

Once the alignment plate 59 has been installed, the vaping device bodies 50 may be filled. The filling process may be accomplished manually or automatically (e.g., by using a robotized filling machine). FIG. 9 depicts an array of cartridges being filled by a robotized filling machine. (For clarity, the figures do not depict the stabilizer/alignment plate 59. In some embodiments, the robotized filling machine dispenses vaping liquid via a needle.

Each vaping device body 50 or cartridge may be designed to be consistent with the filling process. For example, a cartridge may have an annular cylindrical cavity that accepts the vaping solution. For this process, the needle of a robotized filling machine may be inserted into the annular cylindrical cavity, as shown in FIG. 9.

Figure 10:
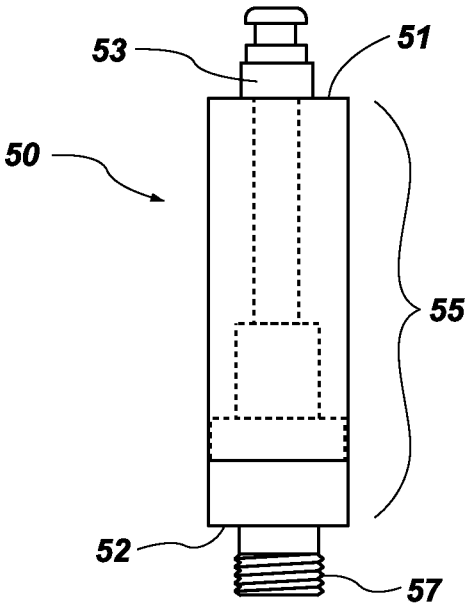
FIG. 10 is a perspective view of a vaping device body.

FIG. 10 depicts an image of a vaping device body or cartridge 50. The proximal end 51 of the vaping device body 50 can have a mouthpiece attached. A central lumen 53 extends past the edge of the tank portion 55 of the vaping device body 50, and can include a projection for a mouthpiece to interface or one-way lock fit. The tank portion 55 of the vaping device body 50 is open on the proximal end 51 to allow the tank portion 55 to be filled with vaping liquid or other substance. A cap (mouthpiece) may be placed over the proximal end 51 during the packaging process.

The bottom side 57 of the vaping device body 50 is placed facing downwards in the jig voids 15 of the jig 10. The threaded portion of the bottom end 57 may be used to interface (i.e., screw into) a power source, battery, etc. The tank portion 55 can also have a metal band surrounding the bottom 52 of the tank portion 55, or a cylindrical metallic portion of the cartridge at the lower end of the cartridge. This band or metallic portion is configured to be wider than the threaded portion of the bottom end 57 of the cartridge 50. That is, the tank portion 55 of the vaping device body 50 is wider than the threaded bottom portion 57 of the vaping device body 50.

In one aspect, the bottom 52 of the tank portion 55 of the vaping device body 50 is used to bear a force associated with a capping process, to prevent any damage to the threaded portion 57 of the cartridge or bottom side of the vaping device body 50. In one aspect, when a vaping device body 50 is inserted into a jig void 15 in the jig 10, the bottom side 52 of the tank portion 55 of the vaping device body 50 rests on the stepped portion 20 of the jig void 15. In other words, the bottom side 52 of the tank portion 55 rest on the surface where the first portion 28 of the jig void 15 transitions to the second portion 32 of the jig void 15. During a capping process when a vertical force is exerted on a cap to affix the vaping device mouthpiece onto the vaping device body 50, the force is transmitted to bottom side 52 of the tank portion 55 that rests on the stepped portion 20 or circular edge surface, rather than on the threaded portion 57 (which would be the case if the stepped portion 20 or circular edge surface was not present). We have found that the bottom side 52 of the tank portion 55 of the vaping device body 50 is better able to bear the force of the capping process, and that this reduces damage to the threaded portion 57 of the cartridge 50.

Figure 11:
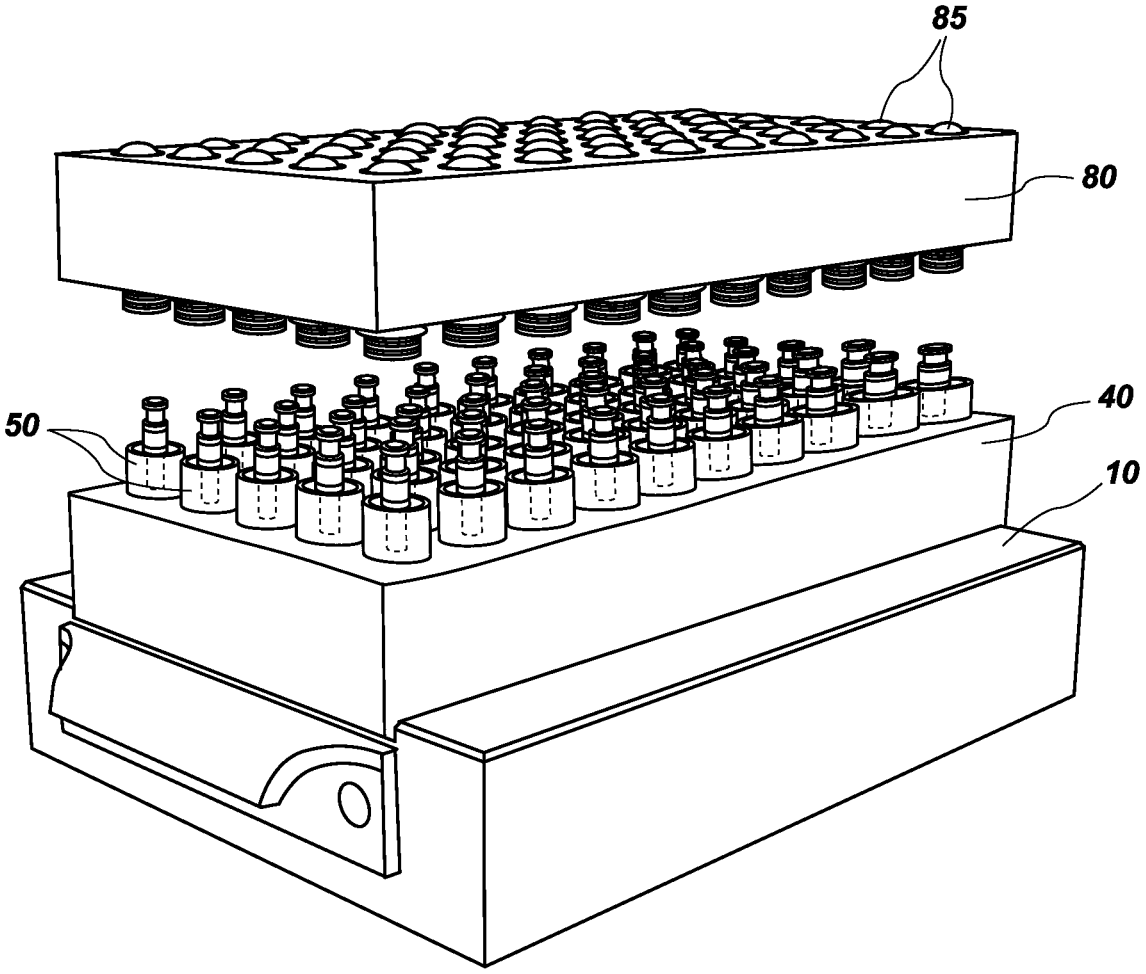
FIG. 11 is a perspective view of a second tray holding vaping device mouthpieces in place in vertical alignment with the first tray to cap the mouthpieces of the second tray onto the corresponding vaping device mouthpieces of the second tray.

After the vaping device bodies 50 have been filled, the next stage is to install a cap (vaping device mouthpiece) on each vaping device body 50. FIG. 11 shows a second tray 80 for holding vaping device mouthpieces 85. The second tray 80 has a plurality of voids allowing the vaping device mouthpieces 85 to be vertically aligned with the vaping device bodies 50 of the first tray 40. Each of the voids holds a portion of a vaping device mouthpiece 85. That is, the portion of the vaping device mouthpiece 85 to be inserted onto the proximal end of the vaping device bodies 50 extends below the second tray 80. In one aspect, the mouthpieces 85 may be collectively placed in a second tray 80 with holes that correspond in geometry and position to the first tray 40.

In one aspect, a mechanical press may be used to fasten each vaping device mouthpiece 85 onto a corresponding vaping device body 50. The second tray 80 is capable of being placed over the first tray 40 to allow a press to exert even pressure on the vaping device mouthpieces 85 of the second tray 80 to press-fit the vaping device mouthpieces 85 onto the corresponding vaping device bodies 50. During the press, in embodiments with stepped portions 20 of the jig void 15, the stepped portion 20 of the jig void 15 transfers pressure from the vaping device mouthpieces 85 to a corresponding bottom side 52 of a tank portion 55 of the vaping device bodies 50 when the press exerts even pressure on the vaping device mouthpieces 85.

In some embodiments, the number of vaping device bodies 50 present in the first tray 40 (and the corresponding number of vaping device mouthpieces 85 present in the second tray 80) may be optimized based on the pressure need to cap the vaping device bodies 50. For example, some vaping device bodies 50 require from about 15 pounds per vaping device body to about 17 pounds per vaping device body 50. A standard press is able to exert a varying amount of force based on how the press is adjusted. In one embodiment, the press is adjusted to exert between around 800 pounds to around 1000 pounds per press. For vaping devices bodies 50 that require from about 15 pounds per vaping device body to about 17 pounds per vaping device body, the number of vaping devices present in the first tray 40 may be 50 to ensure that all 50 devices will be capped by a single press, but also not exert undue excess force on the vaping device bodies 50. It has been found that undue capping force on the vaping device bodies 50 can cause structural damage, leading to leaks and malfunctions.

Figure 12:
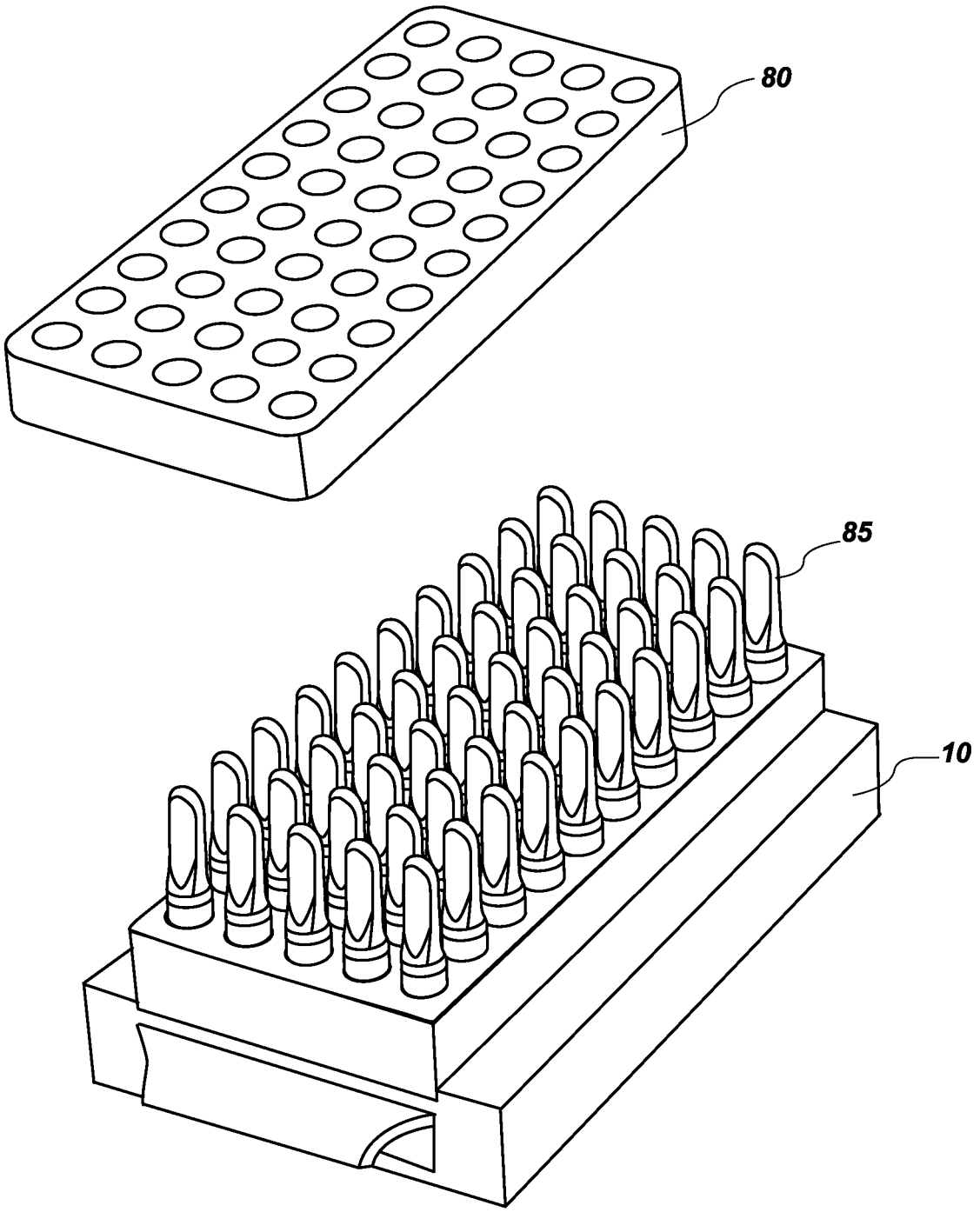
FIG. 12 is a perspective view of a set of capped vaping devices in a jig.

In other examples, the press can be adjusted to provide from about 1.5 tons to about 2 tons of pressure. Other vaping device bodies 50 may require a higher force to cap. For example, some vaping device bodies 50 that include a battery (commonly known as an "all-in-one") may require a higher force to cap and are also designed to withstand a higher capping pressure. For instance, some vaping device bodies may need about 65 pounds to about 70 pounds of pressure per vaping device body 50 (30 kg). These vaping device bodies 50 may be provided in a first tray 40 having approximately 30 voids (65-70 lbs×30 vaping device bodies per pack equals 1950 pounds of pressure required for a single press to cap all 30 vaping device bodies 50). FIG. 12 depicts a set of capped cartridges in a receiver tray. This set of cartridges can be removed from the tray 10 to be shipped to a customer.

In one aspect, while using a receiver tray and stabilizer plate, the following sequence of events may be followed:

To fill a cartridge, blunt tip needle may be inserted into the space between the center airway tube and the inner wall of the cartridge (i.e., into the annular cylindrical cavity). A recommended oil temperature range at time of filling may be 90° F.-130° F. In one aspect, 1.4 mm may be a preferred needle width, with 1.63 mm being the maximum needle width allowed. An 18-gauge needle is 1.27 mm wide. For polyresin cartridges, 14-gauge needles may be used.

For polyresin cartridges, care must be taken so as to not fill above the bottom of the metal band on the open end (top) of the cartridge. For glass cartridges, a user may need to make sure there is no fluid in the top 4 mm of the glass tank. As cautionary measures, a user must ensure that:

a. Oil (i.e., vaping liquid) is not allowed to enter the center airway tube.

b. The cartridge is not overfilled. If the cartridge is overfilled, fluid (e.g., vaping liquid) may be forced through the atomizer and leak out of the bottom of the cartridge when the mouthpiece is capped.

c. The inner surface of the cartridge close to the top opening is free of fluid. Fluid on this surface may act as a lubricant reducing retention of the mouthpiece.

A user may need to be aware that the silicone end cap (e.g., a mouthpiece) can be punctured when too much pressure is applied during capping.

Immediately after filling, the cartridge may be capped with the mouthpiece until the mouthpiece is fully seated. In one aspect, a filled cartridge may need to be capped within three minutes after it has been filled. A shorter time may be recommended for thinner oils. Failure to cap within the appropriate amount of time can lead to leakage and clogging.

Cartridges should be allowed to stand for at least 30 minutes before use. During this time, fluid is priming the atomizer. The rate that the atomizer saturates is dependent upon the viscosity of the fluid. More viscous fluids will require more time. The appropriate aperture setting must be used according to the viscosity of the fluid.

In one aspect, cartridges made from different materials may require different workflows. Instructions to cap different cartridges are as follows.

C1 Polyresin Cartridge Capping Process

After filling, the mouthpiece is pressed into the cartridge until it is fully seated. Mechanical assistance is required to fully seat the mouthpiece. About 45 kgF of force is needed to cap a single cartridge. The cartridge must be upright and centered with the mouthpiece when pressing down. Do not use a hammer or mallet. Once the mouthpiece is fully seated, it cannot be removed without damaging the cartridge or the mouthpiece. Caution: failure to insert the mouthpiece immediately after filling may cause leakage. Do not twist or rotate the mouthpiece while it is being inserted. A misaligned cartridge or pressing at an angle will cause uneven pressure which may lead to leakage. Make sure the cartridge is centered to the arbor press.

C2 Glass Cartridge Capping

After filling, screw-on the mouthpiece until it is fully seated. When using a mechanical capping tool for threaded mouthpieces the torque must be below 3.5 kgF/cm. Caution: failure to cap the mouthpiece immediately after filling may cause leakage. Excessive torque may pull the center airway tube off of the base.

C3 Eazy-Press Glass Cartridge Capping

After filling, insert the mouthpiece, pressing lightly to align it on the center post. After making sure the mouthpiece is properly aligned and straight, press the mouthpiece down vertically (not at an angle) using level, even pressure until a click is heard indicating that it is fully seated. It is possible to seat the mouthpiece by hand, but a light-duty arbor press and jig is recommended. Do not use a hammer or mallet. About 7-8 kg F of force is needed to cap a single cartridge. A misaligned mouthpiece, off-center arbor press, or pressing at an angle can cause the mouthpiece hooks to not engage onto the center post. This can lead to damage, improper seal, leakage, and/or cracking of the glass tank. Once the mouthpiece is fully seated, it cannot be removed without damaging the cartridge or the mouthpiece. Caution: Do not reuse a mouthpiece that failed to seat on the first try. Do not twist or rotate the mouthpiece while it is being inserted. Do not press down even at a slight angle.

Aspects

Aspect 1: A vaping device packaging system comprising:

a first tray formed of deformable material for holding vaping device bodies, the first tray having a plurality of voids, each of the voids holding a portion of a vaping device body to be filled with a substance, and wherein the first tray and the vaping device bodies are covered by a first cover;

a second tray formed of deformable material for holding vaping device mouthpieces, the second tray having a plurality of voids allowing the vaping device mouthpieces to be vertically aligned with the vaping device bodies of the first tray, each of the voids holding a portion of a vaping device mouthpiece to cap a corresponding vaping device body;

wherein the first tray is capable of being placed over a jig having a plurality of jig voids corresponding to the voids for holding the vaping device bodies, and wherein the jig voids comprise a stepped portion within the jig voids, the stepped portion forming a concentric circle with the jig voids; and and wherein the second tray is capable of being placed over the first tray to allow a press to exert even pressure on the vaping device mouthpieces of the second tray to press-fit the vaping device mouthpieces onto the corresponding vaping device bodies, the stepped portion of the jig void for transferring pressure from the vaping device mouthpieces to a corresponding bottom side of a tank portion of the vaping device bodies when the press exerts even pressure on the vaping device mouthpieces.

Aspect 2: The vaping device packaging system of Aspect 1, wherein the plurality of jig voids have a diameter sized to receive a bottom side of the vaping device body and wherein the stepped portion of the jig void has a diameter to receive a tank bottom side.

Aspect 3: The vaping device packaging system of Aspect 1 or Aspect 2, wherein the stepped portion of the jig void has a diameter of from about 0.7 mm to about 0.9 mm.

Aspect 4: The vaping device packaging system of any one of Aspects 1-3, wherein the second tray and the vaping device mouthpieces are covered by a second cover.

Aspect 5: The vaping device packaging system of any one of Aspects 1-4, wherein the jig voids are circular.

Aspect 6: The vaping device packaging system of any one of Aspects 1-5, further comprising at least one first tray in a first package, at least one second tray in the first package, and at least one jig in the first package.

Aspect 7: The vaping device packaging system of any one of Aspects 1-6, wherein the second tray is capable of being placed over the first tray to allow a press to exert even pressure on the vaping device mouthpieces of the second tray to one-way press-fit the vaping device mouthpieces onto the corresponding vaping device bodies.

Aspect 8: The vaping device packaging system of any one of Aspects 1-7, wherein the first tray comprises five rows of ten voids.

Aspect 9: The vaping device packaging system of any one of Aspects 1-8, wherein the first tray is capable of holding a number of vaping device bodies to allow the press to exert from around 200 pounds of pressure to around 900 pounds of pressure per press to press-fit the vaping device mouthpieces onto the corresponding vaping device bodies with a single press.

Aspect 10: A vaping device packaging system comprising:

a first tray for holding vaping device bodies, the first tray having a plurality of voids, the voids holding a portion of a vaping device body to be filled with a substance, and wherein the first tray and the vaping device bodies are covered by a first cover;

a second tray for holding vaping device mouthpieces, the second tray having a plurality of voids allowing the vaping device mouthpieces to be vertically aligned with the vaping device bodies of the first tray, each of the voids holding a portion of a vaping device mouthpiece to cap a corresponding vaping device body; and wherein the first tray is capable of being placed over a jig having a plurality of jig voids corresponding to the voids for holding the vaping device bodies.

Aspect 11: The vaping device packaging system of Aspect 10, wherein at least one of the plurality of jig voids comprises a stepped portion forming a concentric circle within the plurality of jig voids.

Aspect 12: The vaping device packaging system of Aspect 10 or Aspect 11, wherein the second tray is capable of being placed over the first tray to allow a press to exert even pressure on the vaping device mouthpieces of the second tray to press-fit the vaping device mouthpieces onto the corresponding vaping device bodies.

Aspect 13: The vaping device packaging system of any one of Aspects 10-12, wherein the stepped portion of the jig void prevents pressure from being transferred from the vaping device mouthpieces to a bottom side of the vaping device bodies when the press exerts an even pressure on the vaping device mouthpieces.

Aspect 14: The vaping device packaging system of any one of Aspects 10-13, wherein a distance from an outer diameter of the jig void to an inner diameter of the stepped portion is about 0.7 mm to about 0.9 mm.

Aspect 15: The vaping device packaging system of any one of Aspects 10-14, wherein the voids of the second tray are vertically alignable with the corresponding voids of the first tray.

Aspect 16: The vaping device packaging system of any one of Aspects 10-15, wherein the second tray and the vaping device mouthpieces are wrapped in a second cover.

Aspect 17: The vaping device packaging system of any one of Aspects 10-16, wherein the first tray and second tray are formed of deformable material.

Aspect 18: A method of packaging vaping devices, the method comprising:

selecting a first tray for holding vaping device bodies, the first tray having a plurality of voids, inserting a portion of a vaping device body into each of the plurality of voids of the first tray;

covering the first tray and the vaping device bodies with a first cover;

selecting a second tray for holding vaping device mouthpieces, the second tray having a plurality of voids;

inserting a portion of a vaping device mouthpiece into each of the plurality of voids in the second tray.

Aspect 19: A system for filling and capping vaping devices, the system comprising:

a first tray for holding vaping device bodies, the first tray having a plurality of voids, the voids holding a portion of a vaping device body to be filled with a substance, and wherein the first tray and the vaping device bodies are covered by a first cover;

a second tray for holding vaping device mouthpieces, the second tray having a plurality of voids allowing the mouthpieces to be vertically aligned with the vaping device bodies of the first tray, each of the voids holding a portion of a vaping device mouthpiece to cap a corresponding vaping device body; and a jig, the jig defining a plurality of voids that align vertically with the plurality of voids of the first tray.

Aspect 20: The system of Aspect 19, further comprising an alignment plate defining a plurality of voids, each of the plurality of voids for holding a portion of the vaping device bodies, the plurality of voids aligning vertically with the plurality of voids of the first tray and the jig.

The invention claimed is:

1. A vaping device packaging system comprising:

a first tray formed of deformable material for holding vaping device bodies, the first tray having a plurality of voids, each of the voids holding a portion of a vaping device body to be filled with a substance, and wherein the first tray and the vaping device bodies are covered by a first cover;

a second tray formed of deformable material for holding vaping device mouthpieces, the second tray having a plurality of voids allowing the vaping device mouthpieces to be vertically aligned with the vaping device bodies of the first tray, each of the voids holding a portion of a vaping device mouthpiece to cap a corresponding vaping device body;

wherein the first tray is capable of being placed over a jig having a plurality of jig voids corresponding to the voids for holding the vaping device bodies, and wherein the jig voids comprise a stepped portion within the jig voids, the stepped portion forming a concentric circle with the jig voids; and wherein the second tray is capable of being placed over the first tray to allow a press to exert even pressure on the vaping device mouthpieces of the second tray to press-fit the vaping device mouthpieces onto the corresponding vaping device bodies, the stepped portion of the jig void for transferring pressure from the vaping device mouthpieces to a corresponding bottom side of a tank portion of the vaping device bodies when the press exerts even pressure on the vaping device mouthpieces.

2. The vaping device packaging system of claim 1, wherein the plurality of jig voids have a diameter sized to receive a bottom side of the vaping device body and wherein the stepped portion of the jig void has a diameter to receive a tank bottom side.

3. The vaping device packaging system of claim 1, wherein the stepped portion of the jig void has a width of from about 0.7 mm to about 0.9 mm.

4. The vaping device packaging system of claim 1, wherein the second tray and the vaping device mouthpieces are covered by a second cover.

5. The vaping device packaging system of claim 1, wherein the jig voids are circular.

6. The vaping device packaging system of claim 1, comprising at least one first tray in a first package, at least one second tray in the first package, and at least one jig in the first package.

7. The vaping device packaging system of claim 1, wherein the second tray is capable of being placed over the first tray to allow a press to exert even pressure on the vaping device mouthpieces of the second tray to one-way press-fit the vaping device mouthpieces onto the corresponding vaping device bodies.

8. The vaping device packaging system of claim 1, wherein the first tray comprises five rows of ten voids.

9. The vaping device packaging system of claim 1, wherein the first tray is capable of holding a number of vaping device bodies to allow the press to exert from around 200 pounds of pressure to around 900 pounds of pressure per press to press-fit the vaping device mouthpieces onto the corresponding vaping device bodies with a single press.

10. A vaping device packaging system comprising:

a first tray for holding vaping device bodies, the first tray having a plurality of voids, the voids holding a portion of a vaping device body to be filled with a substance, and wherein the first tray and the vaping device bodies are covered by a first cover;

a second tray for holding vaping device mouthpieces, the second tray having a plurality of voids allowing the vaping device mouthpieces to be vertically aligned with the vaping device bodies of the first tray, each of the voids holding a portion of a vaping device mouthpiece to cap a corresponding vaping device body; and wherein the first tray is capable of being placed over a jig having a plurality of jig voids corresponding to the voids for holding the vaping device bodies.

11. The vaping device packaging system of claim 10, wherein at least one of the plurality of jig voids comprises a stepped portion forming a concentric circle with the plurality of jig voids.

12. The vaping device packaging system of claim 10, wherein the second tray is capable of being placed over the first tray to allow a press to exert even pressure on the vaping device mouthpieces of the second tray to press-fit the vaping device mouthpieces onto the corresponding vaping device bodies.

13. The vaping device packaging system of claim 11, wherein the stepped portion of the jig void prevents pressure from being transferred from the vaping device mouthpieces to bottom side of the vaping device bodies when the press exerts an even pressure on the vaping device mouthpieces.

14. The vaping device packaging system of claim 11, wherein a distance from an outer diameter of the jig void to an inner diameter of the stepped portion is about 0.7 mm to about 0.9 mm.

15. The vaping device packaging system of claim 10, wherein the voids of the second tray are vertically alignable with the corresponding voids of the first tray.

16. The vaping device packaging system of claim 10, wherein the second tray and the vaping device mouthpieces are wrapped in a second cover.

17. The vaping device packaging system of claim 10, wherein the first tray and second tray are formed of deformable material.

18. A method of packaging vaping devices, the method comprising:

selecting a first tray for holding vaping device bodies, the first tray having a plurality of voids, inserting a portion of a vaping device body into each of the plurality of voids of the first tray;

covering the first tray and the vaping device bodies with a first cover;

selecting a second tray for holding vaping device mouthpieces, the second tray having a plurality of voids;

inserting a portion of a vaping device mouthpiece into each of the plurality of voids in the second tray.

19. A system for filling and capping vaping devices, the system comprising:

a first tray for holding vaping device bodies, the first tray having a plurality of voids, the voids holding a portion of a vaping device body to be filled with a substance, and wherein the first tray and the vaping device bodies are covered by a first cover;

a second tray for holding vaping device mouthpieces, the second tray having a plurality of voids allowing the mouthpieces to be vertically aligned with the vaping device bodies of the first tray, each of the voids holding a portion of a vaping device mouthpiece to cap a corresponding vaping device body; and a jig, the jig defining a plurality of voids that align vertically with the plurality of voids of the first tray.

20. The system of claim 19, further comprising an alignment plate defining a plurality of voids, each of the plurality of voids for holding a portion of the vaping device bodies, the plurality of voids aligning vertically with the plurality of voids of the first tray and the jig.

* * * * *